US005375342A

United States Patent [19]

Giesler

[11] Patent Number: 5,375,342

[45] Date of Patent: Dec. 27, 1994

[54] COUNTERFLOW AIR COOLER FOR GRANULAR MATERIALS

[75] Inventor: Gary D. Giesler, Wellesley, Canada

[73] Assignee: Donmar Welding & Fabricating Ltd., Canada

[21] Appl. No.: 975,437

[22] Filed: Nov. 12, 1992

[51] Int. Cl.[5] ..... F26B 17/12

[52] U.S. Cl. ..... 34/168; 34/172; 34/436; 34/429; 34/64; 34/391; 414/287

[58] Field of Search ..... 34/20, 164, 167, 168, 34/170, 171, 172, 178, 64, 65, 66, 13, 57 A, 428, 429, 436, 435, 432, 391, 393, 395; 414/287

[56] References Cited

U.S. PATENT DOCUMENTS

| | | | |
|---|---|---|---|
| 2,148,946 | 2/1939 | Hubmann et al. | 34/168 |
| 3,710,453 | 1/1973 | Whelpley | 34/164 |
| 3,833,137 | 9/1974 | Mathews | 34/168 |
| 4,030,206 | 6/1977 | Bode | 34/164 |
| 4,445,282 | 5/1984 | Heinemans | 34/168 |
| 4,455,762 | 6/1984 | Saeman | 34/170 |
| 4,683,665 | 8/1987 | Geelen | 34/65 |
| 4,869,162 | 9/1989 | Schouten | 34/168 |
| 4,991,315 | 2/1991 | Falck | 34/217 |

*Primary Examiner*—Denise L. Gromada
*Attorney, Agent, or Firm*—Bell, Seltzer, Park & Gibson

[57] ABSTRACT

An apparatus is provided for cooling warm granular product. The apparatus includes a grate system having a first grate overlying and second grate. The first grate has a plurality of parallel generally spaced apart members, whereas the second grate has a plurality of parallel equally spaced apart beams. The first and second grate reciprocate relative to each other between a first position in which the product is retained on the grate system and a second position in which the product flows through the grate system. Each of the members in the first grate includes an air flow deflector defining a primary and secondary air outlets for dividing a flow of air into primary and secondary air streams. When the grates are in their relative second position, the secondary air stream is increased to minimize fluidization of the pellet product as it flows through the grate system.

9 Claims, 5 Drawing Sheets

COUNTERFLOW AIR COOLER FOR GRANULAR MATERIALS

FIELD OF THE INVENTION

This invention relates to an apparatus for cooling warm pellets and like granular product.

BACKGROUND OF THE INVENTION

A variety of pellet and like granular product coolers and dyers are available where the most common system for cooling pellets is the conveyor type such as disclosed in U.S. Pat. No. 4,991,351. The product is conveyed a considerable distance while cooling air is directed upwardly through the conveyor to cool the pellet product thereon. Usually the conveyors extend lengthwise, hence, considerable floor space is occupied by the conveyor coolers.

Examples of vertically orientated coolers are found in U.S. Pat. Nos. 4,445,282, 4,683,665 and 4,869,162. The advantage in providing a vertical cooling system is that less flow space is occupied. The problem however is to develop a vertically orientated cooler which can provide similar production rates as the common conveyor system. The cooler of U.S. Pat. No. 4,445,282 has a product inlet at the top of the bin with a product discharge at the base. A reciprocating grate is provided approximately mid-station of the bin to temporarily retain product on the grid. Air is drawn upwardly through the product by way of mounting a fan at the top of the bin to exhaust air from the upper region of the bin. The grate is reciprocated to cause a controlled yet slow downward flow of pellet product through the grate and out through the discharge bin. The grating comprises off-set but overlapping vertically spaced apart baffles which require that the product flow in a zig zag pattern in finding its way through the grate. Cooling air which flows upwardly through the grate tends to cause fluidization of the product above the grate. Although this can be beneficial from the standpoint of cooling the product and also removing surface moisture, such fluidization of the product can cause reduced flow rates of product through the material due to air resistance to a downward flow of product through the grating.

The vertical cooling system of U.S. Pat. No. 4,869,162 is similar in design to that of U.S. Pat. No. 4,445,282. However, the grating system on which the product is retained is of a slightly different design. Flat beams beneath angular shaped baffles reciprocate to cause the product to either be retained on the grate or when the beams are moved such that the spaces therebetween are aligned with spaces between the deflector plates, product flows freely downwardly into the discharge of the bin. When the spacing between the beams is aligned with the interior of the deflector plates air is directed through one or more channels and into the product to effect the cooling and drying thereof. The air flows upwardly through the spaces between the beams. However, as the beams are moved transversely of the deflector plates the air is cut off from the space beneath the deflector plates and is instead directed upwardly through the space between the beams and through the space between the deflector plates. This increased flow of air through this space causes fluidization of the pellet product therein. Either the flow rate of air is reduced to avoid fluidization of the product and hence, prolong the cooling and drying action or if higher air flow rates are retained, fluidization of the product results in reduced flow rates of pellet product through the grates.

A similar problem exists with respect to the vertical cooling tower of U.S. Pat. No. 4,683,665. In this system, an intermediate grate reciprocates relative to the lowermost grate. An uppermost grate remains stationary and has longitudinally extending vertical plates which retard lateral movement of the product as the intermediate and lowermost plates reciprocate. However, fluidization of the product occurs because when the intermediate and lowermost grates are in their one extreme position to provide maximum opening for product to flow downwardly, all air introduced to the system flows correspondingly upwardly through the same pathway. As already explained, for higher flow rates, this results in fluidization of the product and hence, retarding the downward flow of the product through the grating system. Conversely, to avoid product fluidization, the flow rates of air have to be reduced which prolongs the time in cooling the product to the desired temperature before further treating.

The apparatus according to this invention overcomes the above problems by providing a grate system having air deflector designs which provide enhanced cooling while minimizing fluidization of the product.

SUMMARY OF THE INVENTION

According to an aspect to the invention, an apparatus is adapted for cooling warm pellets and like granular product, the apparatus comprises:

i) a bin having a product inlet at its upper end and a product discharge at its lower end, ii) a grate system on which pellet product is temporarily retained to effect cooling thereof, iii) means for developing an upward flow of air through the grate system to cool pellet product retained on the grate system, iv) means for mounting the grate system in the bin, the grate system traversing the bin to ensure thereby that all pellet product passes through the grate system, v) the grate system comprises first and second grates with the first grate overlying the second grate, vi) the mounting means is adapted to permit reciprocal lateral movement between the first grate relative to the second grate, vii) the first grate having a plurality of parallel generally spaced apart members, each member extending across said bin, viii) the second grate having a plurality of parallel equally spaced apart beams, each beam extending parallel to the members and extending across the bin, ix) means for reciprocating the first grate members relative to the second grate beams, the reciprocating means moving the members and beams between a first relative position in which pellet product is retained on the grate system and a second relative position in which pellet product flows through the grate system towards the product discharge, x) the first grate members having a cross-sectional configuration to permit continuous flow of air through the grate system at all times for all relative positions including and between said first and second positions, xi) each of the members having an air flow deflector for dividing a flow of air entering the first grate as such flow of air passes upwardly between the beams of the second grate, into primary and secondary air flows for each first grate member, xii) each of the first grate members having a primary air outlet and a secondary air outlet, each of the primary and secondary air outlets extending along the respective first member, where movement of the air flow deflector relative to the second beam continues to divide air flow into the primary and secondary streams where volume of air flowing through the secondary outlet increases and correspondingly decreases through said the primary outlet as pellet product commences to flow through the primary outlet while the first and second grates move toward the second position.

BRIEF DESCRIPTION OF THE DRAWINGS

Preferred embodiments of the invention are shown in the drawings wherein.

DETAILED DESCRIPTION OF THE PREFERRED EMBODIMENTS

The preferred embodiments of the invention shall be described with respect to particulars of the grating system. It is understood that other aspects of the cooling tower function in a like manner as in prior art coolers.

Figure 1:
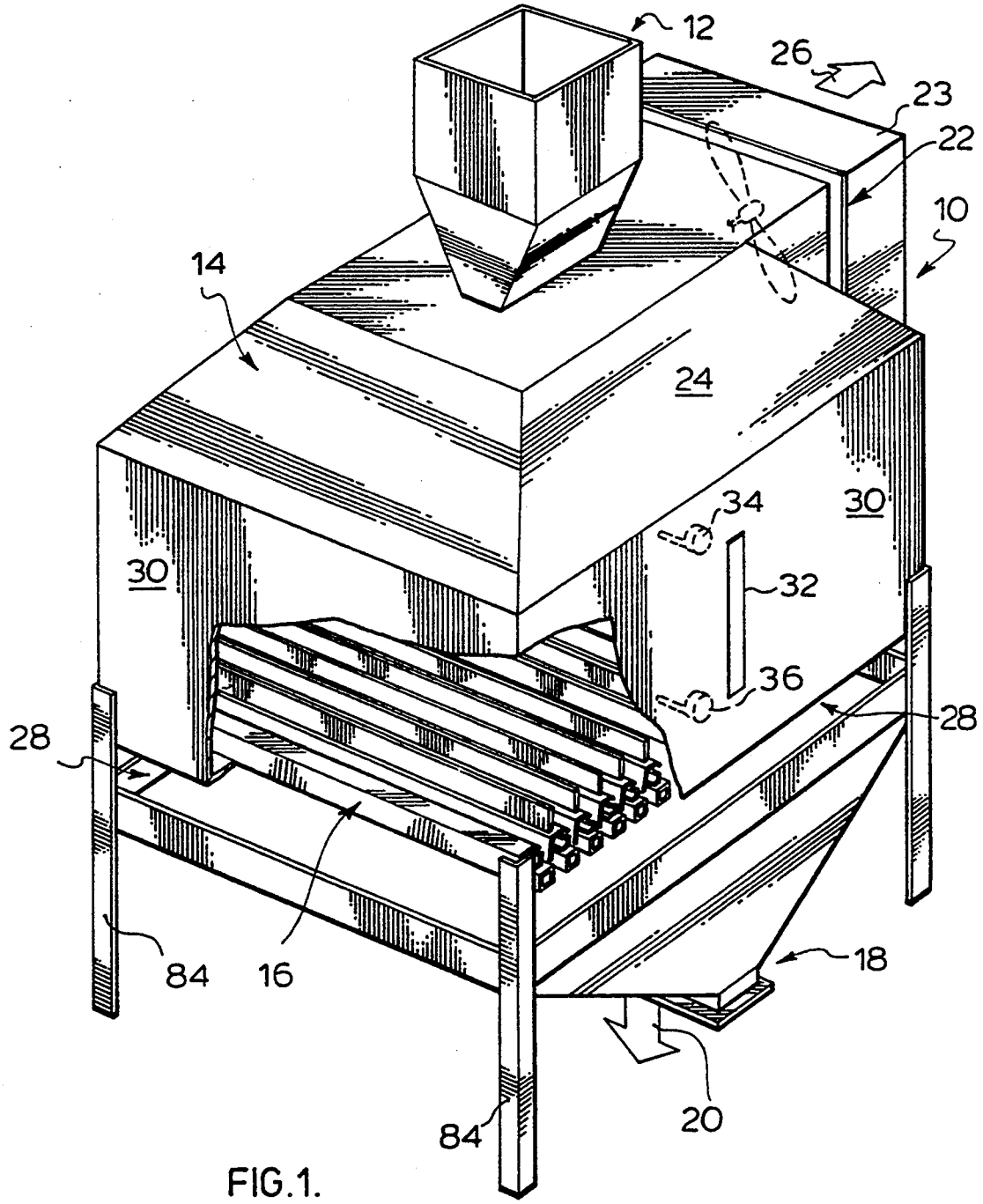
FIG. 1 is a perspective view of the vertical drying system having a grate system according to this invention.

A general representation of the vertically orientated cooling tower 10, is shown in FIG. 1. The tower 10 has a product feed inlet 12, which introduces granular product to the bin 14. A grating system 16 is provided on which the granular product is temporarily retained to effect the necessary cooling and, as desired, drying of the granular product. By movement of the grate system 16 product passes downwardly therethrough to the product discharge 18 where the product drops out in the direction of arrow 20 onto a suitable conveyance device for purposes of further product processing or packaging. A large duct 22 is provided in the bin sloped sidewall 24 to which an inlet for a fan 23 is connected. The fan draws air out of the upper region of the storage bin 14 in the direction of arrow 26. Air is drawn into the bin beneath the grating 16 through the opening 28 which extends around the four vertical sides 30 of the bin 14. A sight glass 32 is provided in the sidewall 30 to permit viewing of the granular product as it is retained above the grate 16 to ensure that product hang-up and/or bunching is not occurring above the grate 16. Also located in the sidewall 30 are product level sensors 34 and 36. The sensors 34 and 36 are connected to a controller for introducing feed to the shoot inlet 12. When sensor 36 no longer senses product above the grate 16, the controller actuates the feed supply to introduce additional product through shoot 12. Once sensor 34 senses, an upper level for the product in the bin 14 the controller ceases to feed product through the shoot 12 until again sensor 36 actuates feed to the bin 14. In this manner, a minimum level of product is retained above the grate 16 as determined by the sensor 36 and a maximum level as determined by sensor 34, which according to this preferred embodiment, prevents the introduction of too much product which could cause caking, bunching and hence, hang-up of the product above the grate system 16.

It is appreciated that the size of the cooling system 10 may very depending upon the product load, For purposes of discussing the preferred embodiments of the invention, a representative feed rate may be in the range of 0.3 metric tonnes/ft.$^2$/hour. The feed is normally in the form of pellets which have diameters in the range of ¼ inch and feed densities in the range of 40 lbs/ft.$^3$. The feed may be at a temperature in the range of 85° C. and a moisture content normally in excess of 15% by weight and up to 20% by weight. Usually the product feed has just been extruded into pellets or other granular form. The purpose of the tower 10 is then to primarily to reduce the temperature of the granular product before further processing and/or containerizing for shipping. It is desired in this preferred embodiment that the tower be capable of reducing the temperature of the product to at least ambient temperature and in some situations as low as 5° C. Usually, by virtue of cooling the granular product with an air stream, the moisture content is correspondingly reduced to a value in the range of 10 to 12% by weight.

It is understood that the velocity of air drawn through the grating 16 is controlled to avoid fluidization to any great extent of the product retained above the grating 12. It is understood that in localized portions of the product above the grating 16 there may be insufficient product which results in fluidization of that specific area. This would normally occur when the levels of the product are getting close to the lower level indicated by sensor 36. However, as soon as further product is introduced through shoot 12 fluidization ceases. In this particular embodiment it has been found that a fan 23 which develops flow rates in the range of 1,350 ft.$^3$/min. is sufficient to effect the necessary cooling but, at the same time, does not cause significant fluidization of the bed of material above the grating. This equates to approximately 220 ft.$^3$/ft.$^2$ of grating. The grating system according to this invention does however provide for a substantial increased flow rate of air through the system without causing any significant fluidization of the bed and, at the same time, not causing hang-up of the product above the grate due to fluidization when the grating system opens up to allow product to drop downwardly towards discharge 18.

Figure 2:
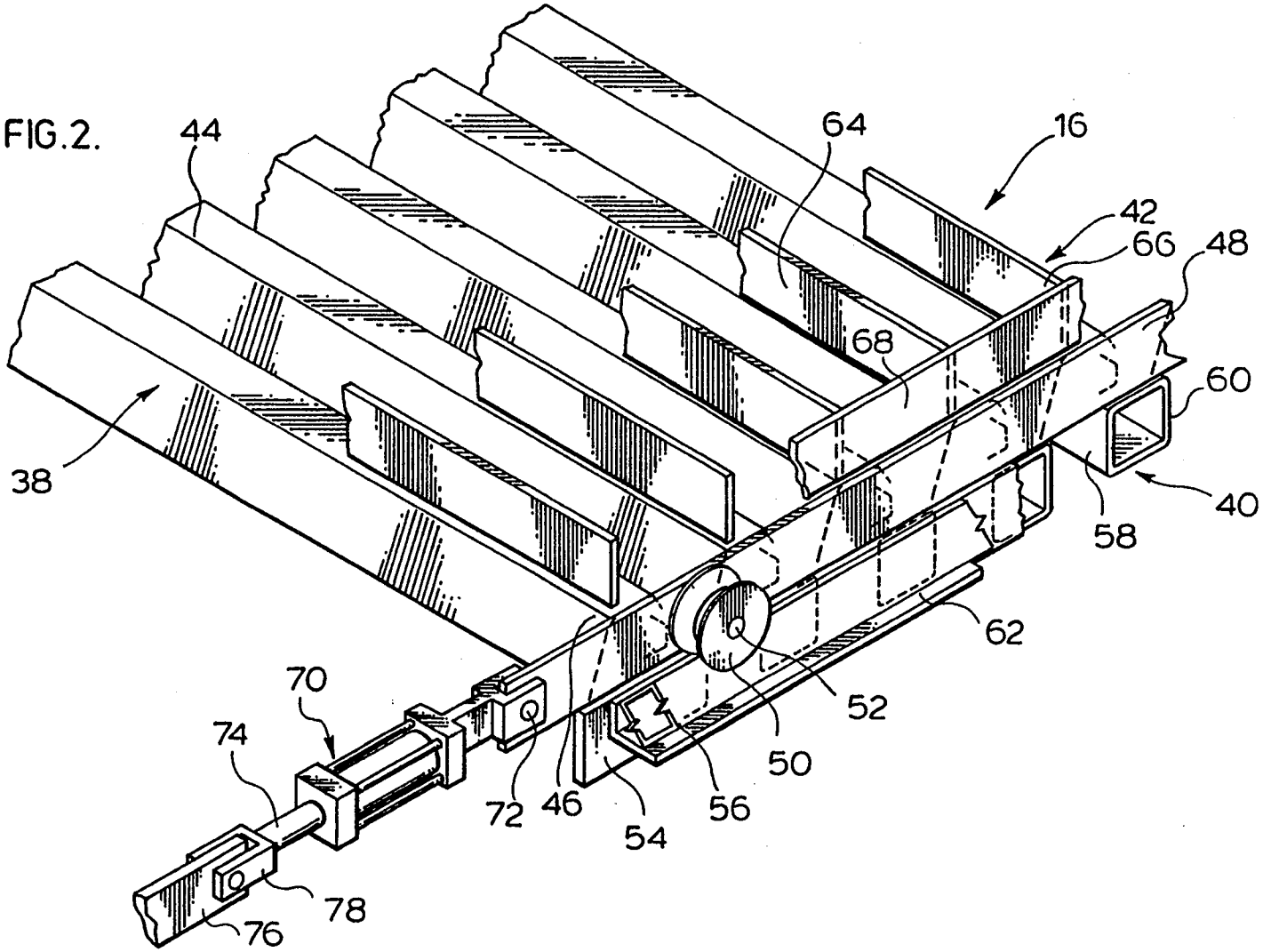
FIG. 2 is an enlarged view of the grate mounting system and the device for reciprocating the grate system.

With reference to FIG. 2 the grating system 16, according to this invention, comprises three separate grates. The central grate which is generally designated as the first grate 38 overlies the second lower grate, generally designated 40. According to this preferred embodiment, a third grate, generally designated 42 is provided above the first grate 38. The first grate 38 has a plurality of parallel, equally spaced apart members 44 which extend across the bin 14. Each end portion 46 of each member 44 is secured to a mounting plate 48. Normally the beams 44 are of metal and hence are welded to the plate 48. Similarly, on the other ends of the members 44 they are welded to a corresponding plate. The plate 48 carries idler rollers 50 which are on shafts 52 secured to plate 48. The idler rollers 50 roll on the support beam 54 which is strengthened by triangular shaped beam 56.

The second grate 40 has individual members 58 with their end portions 60 welded to the plate 54. Correspondingly, the other ends of the members 58 are welded to a similar plate. The box shaped beam 56 has a lower lip 62 which rests on a corresponding ledge of the bin 10 which is mounted on the interior of sidewall 30.

The third grate 42 has parallel spaced apart upwardly extending plates 64 having their end portions 66 secured to plate 68. Plate 68 is in turn secured to the interior of the bin sidewall 30. Hence, the grating system 16 is mounted within the bin by the mounting system comprising beam 48 for grate 38, beam 54 for grate 40 and beam 68 for grate 42. This mounting system is adapted to provide for reciprocal movement of the grate 38 relative to the fixed grates 40 and 42. In accordance with this preferred embodiment, the reciprocal movement is permitted by virtue of the rollers 50 rolling along the beam 56 where such movement is driven by a double acting hydraulic cylinder 70. The hydraulic cylinder is coupled to the beam 48 by connector 72. The piston 74 of the hydraulic cylinder is connected to member 76 by connector 78. Member 76 is in turn fixed relative to the bin 14. By controlling the supply of pressurized hydraulic oil to the cylinder 70 the corresponding inward and outward movement of the piston 74 determines the reciprocal motion of the movable grate 38 in the manner to be discussed with respect to FIGS. 3, 4 and 5.

Figure 3:
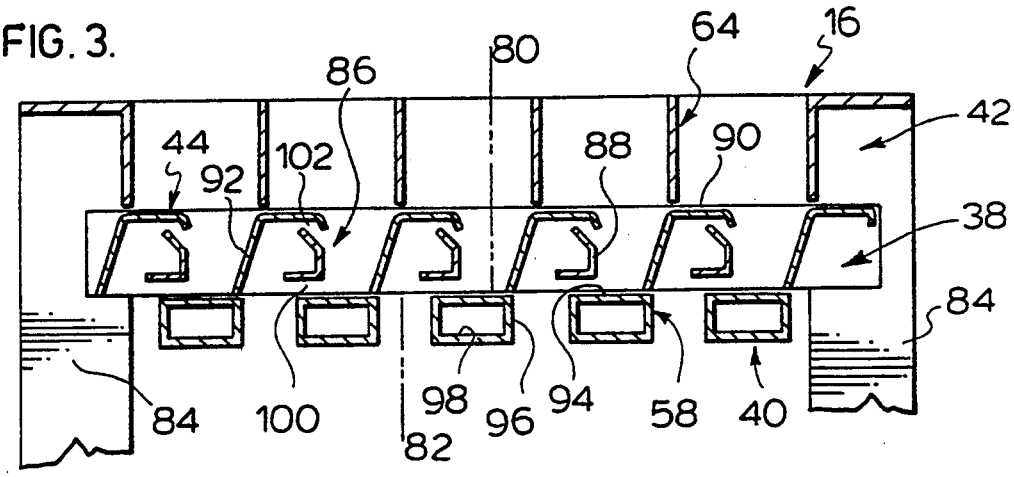
FIGS. 3, 4 and 5 are sections through the grate system of this invention showing three different relative positions for the grating in moving from a material retaining position to a material flow position.

FIG. 3 is a section across the grating system 16. The section is broken along lines 80 and 82 for purposes of illustration. A respective corner post 84 is shown at each end of the grating system 16 otherwise, details of the mounting system are not shown for the sake of clarity. The individual members 44 of the first grate 38 have an air deflector 86. According to this particular embodiment, the air deflector 86 is part of a skirt portion 88 which extends downwardly from an upper flat plate portion 90. On the other side of the flat portion 90 is a skirt portion 92 which extends downwardly to and is adjacent the upper flat portion 94 of the respective member 58 of the second grid 40. According to this particular embodiment, the respective member 58 is of the common box beam design having the downwardly extending sidewalls 96 with bottom wall 98.

The upper flat plate portion of the member 44, according to this particular embodiment is adjacent the respective upright plate 64 of the third grate 42. The air deflector 86 for each member 44 defines a primary air outlet 100 and a secondary air outlet 102. These are the only outlets because skirt 92 extends down to the upper surface 94 of the respective member 58. Hence, air, as it is drawn into the cooler through opening 28 travels upwardly between the members 58 and through the primary and secondary openings 100 and 102 which affect a cooling of the granular product retained on the grating system 16 in a manner to be discussed in more detail with respect to the embodiments of FIGS. 6 and 8.

Figure 4:
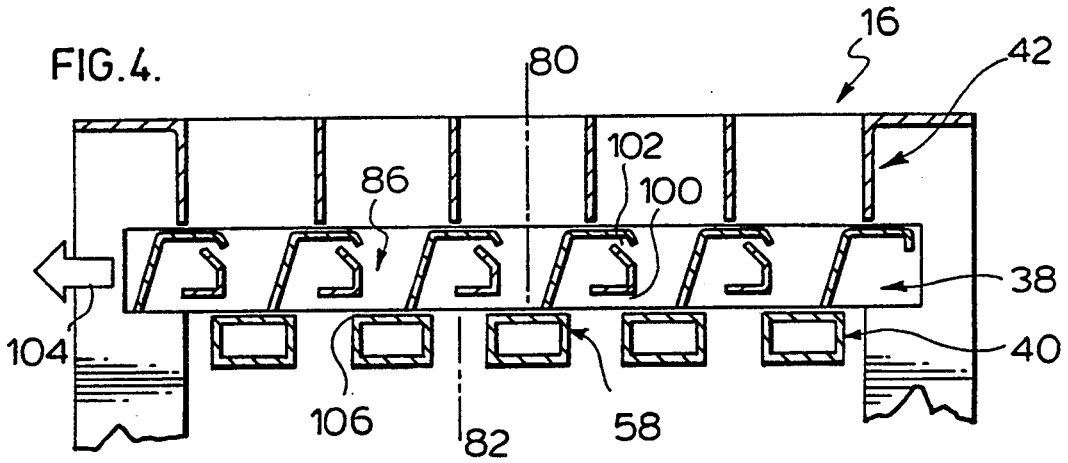
Figure 5:
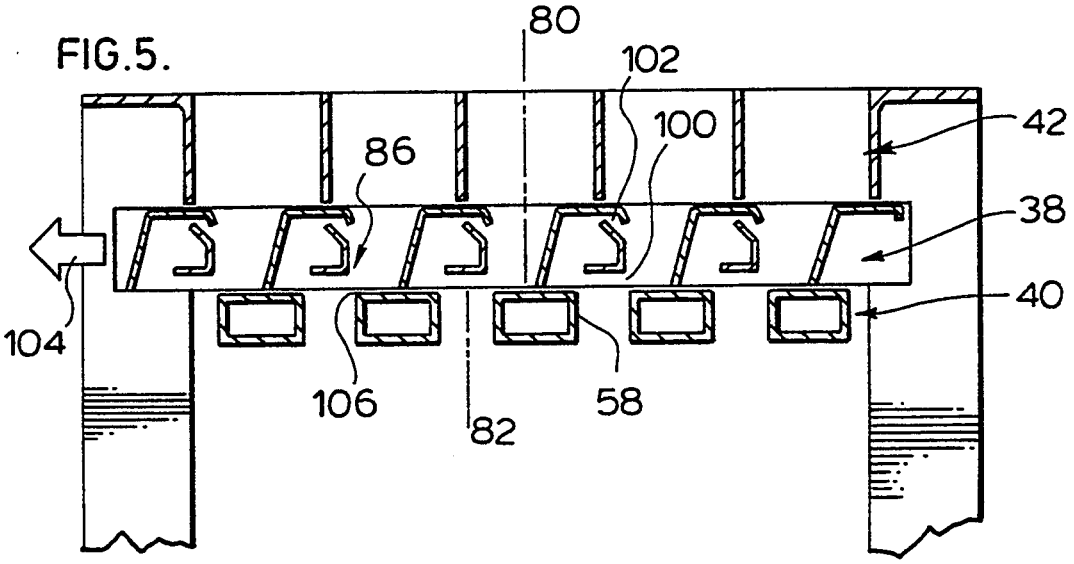

The first relative position of the first and second grates 38 and 40 is shown in FIG. 3. For this relative position of the two grates, product is retained on the grating system 16. As shown in FIG. 3, the respective skirt portion 92 of the member 44 contacts the upper flat surface of the beam 58. The primary air outlet 100 is sized such that granular product is held up on the flat surface 94 and does not drop through the opening 100. As shown in FIGS. 4 and 5, this region continues to open up for purposes of allowing granular product retained on the grating 16 to flow therethrough towards the product discharge 18. For the particular arrangement of the hydraulic cylinder, as shown in FIG. 2, the piston 74 is retracted to cause movement of the grate 38 in the direction of arrow 104. Since grates 40 and 42 are fixed in accordance with this embodiment movement of grate 38 in direction of arrow 104 moves the air deflector 86 of the member 44 further towards the edge 106 of the respective beam 58. Such movement causes opening of the primary outlet 100 while the secondary outlet 102 remains the same due to air deflector 86 being fixed relative to the corresponding member 44. This becomes important from the standpoint of accomplishing continued high flow rates of air through the material without causing fluidization of the material which commences to flow through the primary outlet 100 as it opens up.

Figure 6:
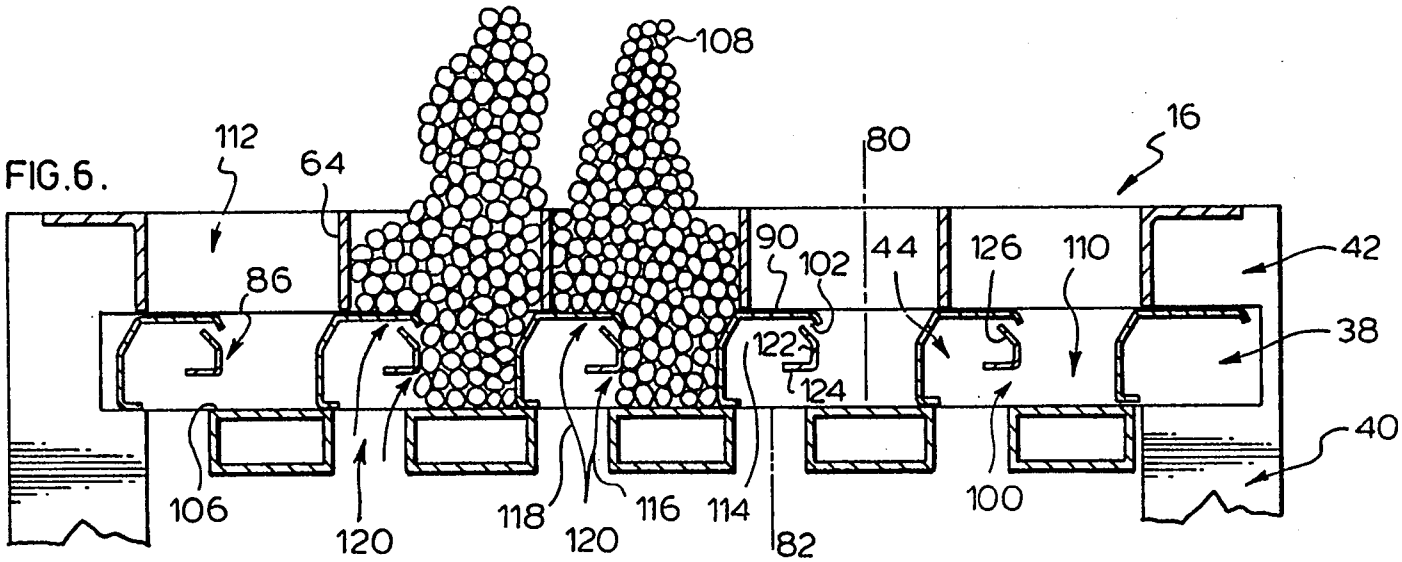
FIGS. 6 and 7 are an enlarged view of the grating system of FIGS. 3 and 5 where the manner in which the air flows through the grating system is demonstrated for the two extreme positions of the grating.
Figure 8:
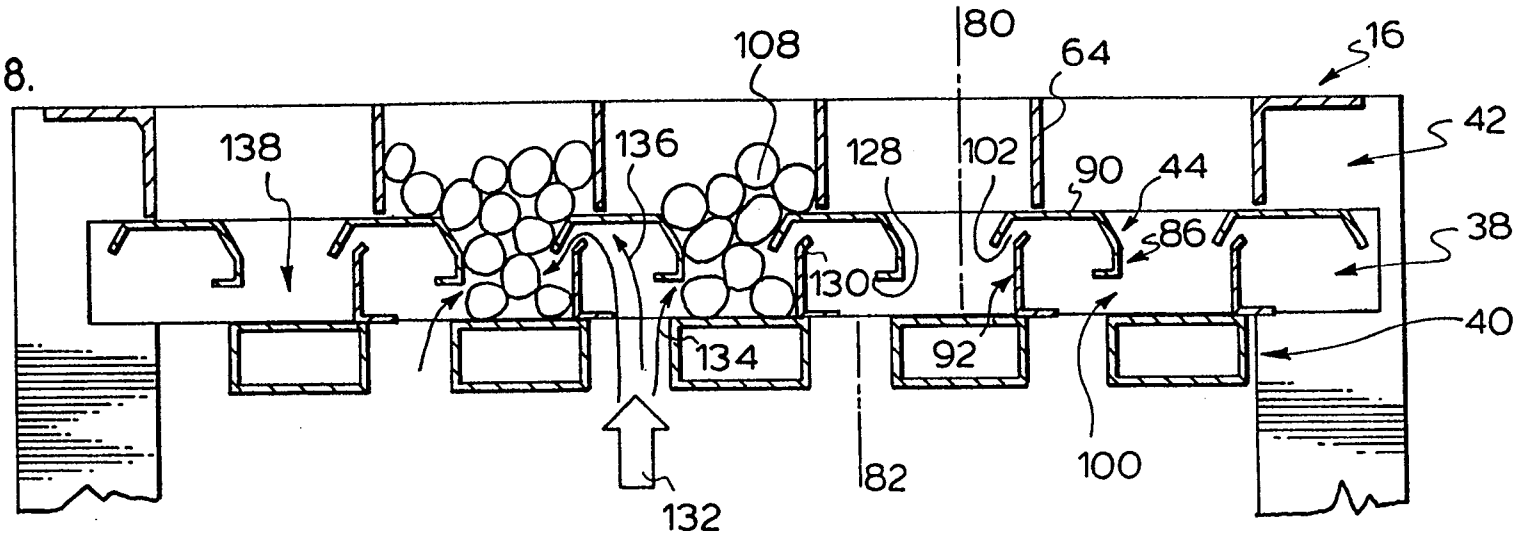
FIGS. 8 and 9 are similar to FIGS. 6 and 7 for demonstrating an alternative embodiment for the deflector design of the grating system.

As shown in FIG. 5, continued movement of the grate 38 in the direction of arrow 104 causes the deflector 86 to move relative to edge 106 of the beam 58 to further open the primary outlet 100 to the extent shown while secondary outlet 102 remains unchanged, the importance of which is further emphasized with respect to the embodiments of FIGS. 6 and 8. It is appreciated that the stroke of the hydraulic cylinder 70 may be varied to thereby determine the maximum outward movement of grate 38 in direction of arrow 104. The extent of movement determines the maximum size for the primary outlet 100 and hence, determines the rate of flow for a particular size of granular product through the primary outlet towards the product discharge 18. It is also understood that movement of the grate 38 relative to grate 40 may also be accomplished by movement of both grates in opposite directions. This however necessitates modification of the mounting device to provide for, not only reciprocal of grate 38 but as well, grate 40. This additional mounting may be necessary when the overall stroke for grate 38 cannot be achieved within the confines of the bin. Hence, the stroke of grate 38 could be cut in half if grate 40 were moved in the opposite direction to thereby attain the same relative position as shown in FIG. 5.

In FIG. 6 pelletized product 108 is shown as retained on grating system 16. The pelletized product 108 is at a level above the position of sensor 36. The product is trapped in the spaces 110 between the members 44 of the first grate 38. The product is of a size which does not readily pass through the primary air outlet 100. Some of the pelletized product is located in the spaces 112 between the vertical plates 64 of the third grate 42. The purpose of the plate 64 is to minimize lateral shifting of the pelletized product 108 in either direction when the first grate 38 is moved back and forth. Plate 64 therefore ensures that the product 108 is evenly distributed across the top of the grating system 16. It is understood however with certain types of products and in certain circumstances for processing purposes the third grate 42 is not necessary because due to the rate at which grate 38 reciprocates, the product over top of the grate will not shift appreciably in either direction.

In the first position shown in FIG. 6 the product 108 rests on the upper plate portions 90 of the first members and naturally fills the space 110. As already indicated, due to the sizing of the opening 100 defined between the air deflector 86 and edge 106 of the respective beam, the product is trapped in the space 110 and naturally builds above that in the spaces 112 up to the upper level of the product retained on the grate system. By sizing of the secondary outlet 102, none of the product moves upwardly into the secondary outlet, hence, the space 114 beneath the plate 90 and within the respective member 44 is free of any granular product. As shown in FIG. 6, the deflector plate 86 defines a primary air stream 116 and a secondary air stream 118. By virtue of the pelletized product being blocked from entering the space within the respective member 44, the secondary air stream 118 is always clear of pelletized product whereas the primary air stream 116, as it travels through the primary outlet 100, always encounters pelletized product.

In accordance with the embodiment of FIG. 6, the air deflector 86 divides the incoming main air stream 120 into the primary and secondary streams 116 and 118. The primary air stream 116 carries the largest volume of air which is directed upwardly through the product 108. Such major volume of air does the majority of work in cooling the pelletized product 108 and as well removing at least surface moisture therefrom. The volume of air in secondary stream 118 as it exits the respective secondary outlet 102 provides the minor volume of air needed to complete the overall temperature reduction and as needed the surface moisture reduction on the pelletized product 108.

The air deflector 86 is designed to direct the secondary air stream 118 in a downward direction into the pelletized product 108. As the downward directed stream encounters the primary upflowing stream both streams then flow upwardly through the product 108 to continue the cooling of the product. The sum of the volume of air flows through the primary and secondary outlets always equals the total flow of air through the fan inlet, except for minor ingress of air through seams and the like of the bin wall.

Figure 7:
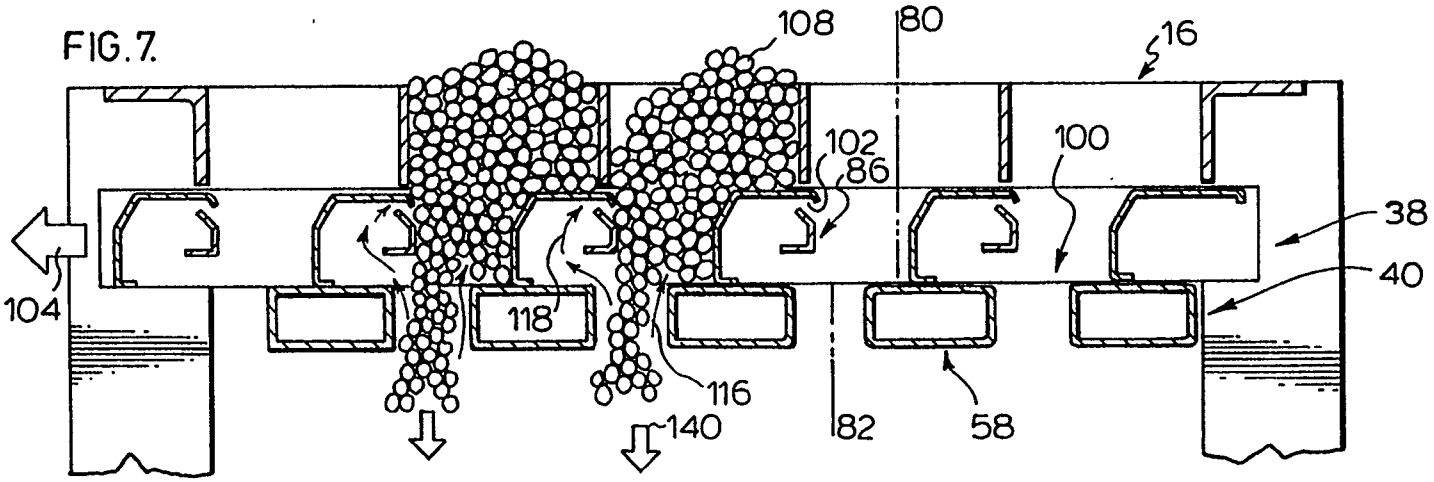

In accordance with this particular embodiment, the air deflector 86 has downwardly directed skirt portion 122 with inwardly directed leg 124. The secondary opening 102 is defined by sloping flange 126. By virtue of the granular product trapped in space 110 the flow of air is divided by the air deflector 86 such that the secondary stream 118 is developed and continuously flows through the secondary outlet 102. By splitting up the upwardly flowing stream 120 into primary and secondary streams, fluidization of the pellet product 118 is minimized because there is not an adequate flow velocity of air through the primary outlet 100 to effect fluidization of the pelletized product. In accordance with this invention, by always retaining a flow of secondary air through the secondary outlet fluidization of the product is avoided even when the grate 38 is moved to its maximum outermost position, as shown in FIG. 7. In accordance with this embodiment, primary air continues to flow as stream 116 through the enlarged opening 100. However, there is a rapid downward flow of granular product through this primary opening 100. As a result, more air is deflected upwardly along secondary stream 118 and through the secondary outlet 102, and in some circumstances the flow of air through the secondary outlet may now exceed the air flow through the primary outlet. By virtue of always maintaining an air flow through the secondary stream through outlet 102 there is not sufficient air velocity through the primary outlet 100 to effect fluidization of the particles 108 as they flow downwardly through the grating system 16. Therefore as the air deflector 86 moves relative to the respective beam 58 of the second grate 40 there results in an increased flow of air through the secondary outlet 102 while there is a decreased flow of air through the primary outlet 100. This balancing of the air flow, while always retaining the maximum flow of air through the system ensures expedited cooling of the pellet product which could not be achieved with prior art devices.

An alternative arrangement for the air deflector is shown in FIG. 8. Product 108 is retained at the level shown on the grating system 16. As with FIG. 6 the grate 42 partitions the space above grate 38 by virtue of the vertical plate 64 to retard shifting of the product in the bin 14. Each member 44 of the grate 38 has the same top plate 90. Skirt portion 86 extends downwardly to the extent shown to define the primary outlet 100. The secondary outlet 102 is provided in the other skirt 92 which has the opening 102 provided therein. The air deflector is constituted in accordance with this embodiment by lips 128 and 130 of the respective skirts to provide a division of the upward flow of air in a direction of arrow 132 into primary stream 134 and a secondary stream 136. As described with respect to the embodiment of FIG. 6, the primary air stream 134 rises through the primary outlet 100 and upwardly through the product 108. Also, as with the embodiment of FIG. 6, the product 108 is trapped in the space 138 as defined between the respective members 44 so that on the one side of the space 138 primary air enters through primary outlet 100. On the opposite side of space 138 secondary air enters through secondary outlet 102.

Figure 9:
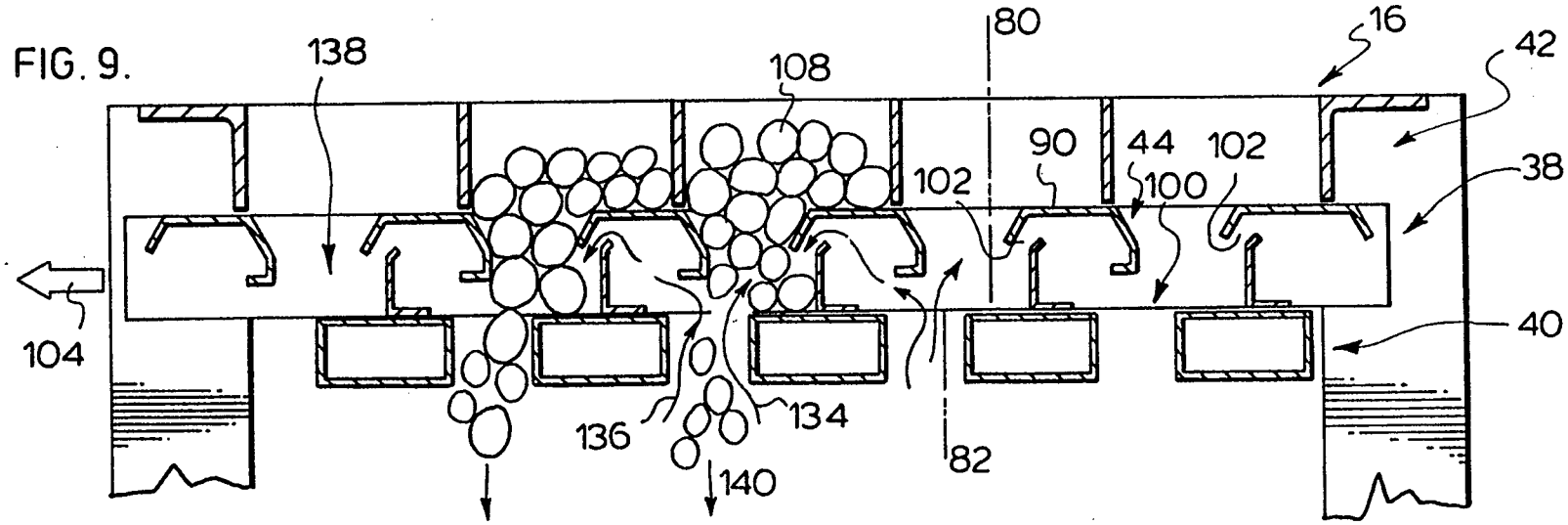

As with the embodiment of FIGS. 6 and 7, the alternative embodiment of FIGS. 8 and 9 ensure that air travelling upward in the direction of stream 132 is always divided into primary and secondary streams with continuous flow through each stream during product retention and product flow through the grating system 16.

As with the embodiment of FIG. 7, the grate 38 is moved in the direction of arrow 104 to achieve maximum opening of the primary outlet 100. As shown in FIG. 9, product 108 flows downwardly in the direction of arrow 140. Meanwhile, the upwardly flowing air stream 132 continues to be divided by the air deflector 128 into the primary stream 134 and secondary air stream 136. This division of the air stream ensures continuous flow of air upwardly through the product while diverting more of the air through the secondary air stream 136 than through the primary air stream 134. As explained with respect to the embodiment of FIG. 7, this avoids fluidization of the product 108 directly above the respective space 138 of the first grate 38. Furthermore, by virtue of retaining a clear space beneath the plate 90 of the respective member 44, the secondary air stream encounters less resistance in flowing out through the secondary outlet 102. In this manner, for a selected flow of air upwardly through the grating system 16, regardless of the position of the first grate 38 relative to the second grate 40, air continues to flow at the total flow rate through the primary and secondary air outlets.

It is appreciated that with movement of the first grate 38 in a reversed direction to arrow 104, flow of product through the primary air outlet decreases until it becomes trapped in the product retention position, as shown respectively in FIGS. 6 and 8. During that process of retracting the first grate 38, the primary air outlet size reduces while less product flows therethrough to permit a greater flow of air through the primary outlet while reducing flow of air through the secondary outlet. In this manner during the reciprocal motion of the grate, air flows through the primary and secondary outlets are constantly changing but the total flow as determined by the fan located at the outlet 22 always remains the same.

The reciprocation of the grate 38 may be either on a continuous of intermittent basis. For the product specifications referenced with respect to this preferred embodiment a continuous motion of the grate is preferred with approximately 34 to 38 strokes per minute. This accommodates the feed rate of 0.3 metric tonnes/ft.$^2$/h while at the same time achieving the desired rate of cooling of the pellet product.

In accordance with this invention for a particular feed rate and corresponding size of vertically oriented cooling tower, more product per unit of time can be cooled for processing purposes than compared to prior art devices. This is accomplished in accordance with this invention by the provision of primary and secondary air flow streams in the reciprocating grate system where air flows continuously at all times through both the primary and secondary air stream channels and out through the corresponding outlets. By varying the flow of air through the primary and secondary outlets, as determined by movement of the air deflector of the respective member of the grate 38, adjustment is made in the amount of primary air flowing up through the material when the grate if moving towards the open position to avoid fluidization and to reduce resistance to the product flowing downwardly through the grate system. Furthermore, such advantages and features of the invention are accomplished by rigid construction for the beams of the reciprocal grate 38 therefore requiring less service and maintenance and upkeep.

Although preferred embodiments of the invention are described herein in detail, it will be understood by those skilled in the art that variations may be made thereto without departing from the spirit of the invention or the scope of the appended claims.

I claim:

1. An apparatus adapted for cooling warm pellet product comprising:

(i) a bin having a product inlet at its upper end and a product discharge at its lower end, (ii) a grate system on which pellet product is temporarily retained to effect cooling and surface drying thereof, (iii) means for developing an upward flow of air through said grate system to cool and surface dry pellet product retained on said grate system, (iv) means for mounting said grate system in said bin, said grate system traversing said bin to ensure thereby that all pellet product passes through said grate system, (v) said grate system comprising first and second grates with said first grate overlying said second grate, (vi) said mounting means being adapted to permit reciprocal lateral movement between said first grate relative to said second grate, (vii) said first grate having a plurality of parallel generally spaced apart members, each member extending across said bin, (viii) said second grate having a plurality of parallel equally spaced apart beams, each beam extending parallel to said members and extending across said bin, (ix) means for reciprocating said members relative to said beams, said reciprocating means moving said members and beams between a first relative position in which pellet product is retained on said grate system and a second relative position in which pellet product flows through said grate system towards said product discharge, (x) said first grate members having a cross-sectional configuration to permit continuous flow of air through said grate system at all times for all relative positions including and between said first and second positions, (xi) each of said members having an air flow deflector defining a primary air outlet and a secondary air outlet, said deflector dividing a flow of air entering said first grate as such flow of air passes upwardly between said beams of said second grate, into primary and secondary air flows for each first grate member, said air flow deflector being located relative to a corresponding one of said second grate beams for any relative position of said first grate to said second grate, to block any pellet product from said secondary stream flowing through said first grate member, (xii) each of said primary and secondary air outlets extending along said respective first grate member, movement of said air flow deflector relative to second beams of said second grate continues to divide air flow into said primary and secondary streams where volume of air flowing through said secondary outlet increases and correspondingly decreases through said primary outlet as pellet product commences to flow through said primary outlet while said first and second grates move toward said second position, said air flow deflector being located relative to said beam to direct a greater volume of air flow through said secondary outlet than through said primary outlet when said first and second grates are in said second position, said air flow deflector defining a constant cross-sectional area for said secondary outlet, said primary outlet having a variable cross-sectional area by virtue of said air flow deflector moving relative to said beam, said air flow deflector defining a maximum cross-sectional area for said primary outlet when said first and second grates are in said second relative position to provide maximum product flow through said primary outlet, said air deflector in providing decreased upward air flow through said primary outlet reducing air resistance to downward flow of pellet product through said primary outlet.

2. An apparatus of claim 1, wherein said second grate is fixed by said mounting means in said bin, said mounting means permitting reciprocal motion of said first grate.

3. An apparatus of claim 2, wherein a third grate is provided above said first grate and is fixed by said mounting means in said bin, said third grate comprising a plurality of upright plates extending in a direction parallel to said first grate members, said third grate plates retarding lateral shifting of product during reciprocation of said first grate.

4. An apparatus of claim 3, wherein said first grate member comprises an upper flat plate adjacent a corresponding said upright plate of said third grate, with downwardly directed first and second skirt portions, said first skirt extending down to and having a lower edge portion adjacent a corresponding said beam of said second grate, said second skirt extending downward towards a corresponding said beam, said second skirt comprising said air deflector whereby said primary air outlet is defined between said second skirt lower edge and said corresponding beam, each of said beams of said second grate having an upper flat portion over which said first skirt portion travels.

5. An apparatus of claim 4, wherein said secondary air outlet is provided in said second skirt portion near said upper flat plate.

6. An apparatus of claim 4, wherein said secondary air outlet is provided in said first skirt portion near said upper flat plate.

7. An apparatus of claim 5, wherein a drive means connected to said first grate reciprocates said first grate with a continuous motion.

8. An apparatus of claim 6 wherein a drive means connected to said first grate reciprocates said first grate with a continuous motion.

9. An apparatus of claim 1, wherein said means for developing said upward flow of air is a fan mounted on said bin and having an inlet in said upper end.

* * * * *